US010674284B2

(12) United States Patent
Best et al.

(10) Patent No.: US 10,674,284 B2
(45) Date of Patent: Jun. 2, 2020

(54) METHOD OF OPERATING A HEARING DEVICE AND A HEARING DEVICE

(71) Applicant: SIVANTOS PTE. LTD., Singapore (SG)

(72) Inventors: Sebastian Best, Erlangen (DE); Cecil Wilson, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/197,679

(22) Filed: Nov. 21, 2018

(65) Prior Publication Data

US 2019/0158963 A1 May 23, 2019

(30) Foreign Application Priority Data

Nov. 23, 2017 (DE) ..... 10 2017 221 006

(51) Int. Cl.
*H04R 25/00* (2006.01)
*H04R 3/00* (2006.01)

(52) U.S. Cl.
CPC ..... *H04R 25/453* (2013.01); *H04R 3/005* (2013.01); *H04R 25/405* (2013.01); *H04R 25/407* (2013.01); *H04R 25/505* (2013.01); *H04R 2225/41* (2013.01); *H04R 2225/43* (2013.01)

(58) Field of Classification Search
CPC H04R 25/453; H04R 25/407; H04R 2225/41; H04R 3/005; H04R 25/405; H04R 25/505; H04R 2225/43; G10K 11/175
See application file for complete search history.

(56) References Cited

U.S. PATENT DOCUMENTS

2009/0067651 A1* 3/2009 Klinkby ..... H04R 25/453 381/313
2009/0175466 A1* 7/2009 Elko ..... H04R 3/005 381/94.2

FOREIGN PATENT DOCUMENTS

DE 10114101 A1 6/2002
DE 102012206759 A1 10/2013
EP 2107826 A1 10/2009
EP 2658289 A1 10/2013

OTHER PUBLICATIONS

Ulrich, J.; Hoffmann, E.: Hoerakustik—Theorie und Praxis. Heidelberg : DOZ Verlag, 2007. 748.—ISBN ISBN 978-3-9222269-80-9.

* cited by examiner

*Primary Examiner* — Sunita Joshi
(74) *Attorney, Agent, or Firm* — Laurence A. Greenberg; Werner H. Stemer; Ralph E. Locher

(57) ABSTRACT

A method operates a hearing device where a first directional signal and a second directional signal are generated in the hearing device from a sound signal of the environment. A parameter is determined based on the first directional signal and the second directional signal, which represents a quantitative measure of the stationarity of a sound signal. A noise-optimized signal is generated from the first directional signal and the second directional signal based on the parameter. The method is performed by a hearing device having a first microphone and a second microphone for generating a first directional signal and a second directional signal. The hearing device is configured to implement the corresponding method.

8 Claims, 1 Drawing Sheet

METHOD OF OPERATING A HEARING DEVICE AND A HEARING DEVICE

CROSS-REFERENCE TO RELATED APPLICATION

This application claims the priority, under 35 U.S.C. § 119, of German application DE 10 2017 221 006.0, filed Nov. 23, 2017; the prior application is herewith incorporated by reference in its entirety.

BACKGROUND OF THE INVENTION

Field of the Invention

The invention relates to a method of operating a hearing device where a first directional signal and a second directional signal are generated in the hearing device from a sound signal of the environment, and a noise-optimized signal is generated from the first directional signal and the second directional signal.

In hearing devices, one of the most common problems is how to improve the signal-to-noise ratio (SNR) for certain hearing situations. This is often achieved by use of directional signal processing algorithms. In this case, it is often assumed that a strongly localized useful signal component is present in the sound signal from the environment that enters the hearing device, for example in the form of conversational contributions by a conversation partner. By use of directional signals in the hearing device, this useful signal component is distinguished from a background that is assumed to be a noise signal, although the noise signal may also have considerable directionality. In general, such algorithms often use self-optimization, wherein the directional characteristic of a directional signal is adapted in such a way as to minimize the influence of interference signals from the direction in which their contribution is greatest. Usually, this is done by minimizing the signal power of a corresponding directional signal.

In a first-order differential directional microphone with only one adaptation coefficient, a directional output signal is often achieved by a linear combination of a forward-facing cardioid with a backward-facing cardioid. A change in the directional characteristic may be achieved via the adaptation coefficient, which determines the contribution of the backward-facing cardioid. As a result, contributions may be reduced from interference sources that may be in a wide solid angle range with respect to the forward direction of the hearing device. The adaptation is often such that the energy of the output signal is minimized, because it is assumed that the wearer of the hearing device will align their line of sight to the useful signal source, which is represented by the forward-facing cardioid constant signal component of the output signal; in consequence, signals from other directions are assumed to be interference and are suppressed via the corresponding portion of the backward-facing cardioid.

If, however, a useful signal does not come from the forward direction, for example, conversation contributions from a speaker positioned laterally to the wearer, these signals are correspondingly attenuated.

SUMMARY OF THE INVENTION

The invention is therefore based on the objective of specifying a method of operating a hearing device, by which interference may be suppressed with the minimum possible impact by a useful signal regardless of its direction.

The objective is achieved according to the invention by a method of operating a hearing device where a first directional signal and a second directional signal are generated in the hearing device from a sound signal of the environment. A parameter is determined based on the first directional signal and the second directional signal, which represents a quantitative measure of the stationarity of a sound signal. A noise-optimized signal is generated from the first directional signal and the second directional signal based on the parameter, and the parameter is determined from the noise-optimized signal in a signal feedback loop. Advantageous configurations, which are themselves inventive in part, are the subject matter of the dependent claims and the following description.

Preferably, the first directional signal and the second directional signal are respectively generated on the basis of corresponding signals from at least two input sound transducers, which may be furnished through microphones, for example. "Directional signal" herein refers respectively to a signal having a non-trivial directional characteristic, i.e. for a test sound with a constant sound pressure and the corresponding test sound source at a constant distance to the hearing device, the sensitivity to the test sound in the respective directional signal has a measurable, and preferably considerable, directionality and in particular angularity in the transverse plane of the wearer.

"A quantitative measure of stationarity" herein refers in particular to a measure that assigns a numerical value to a signal such that the extremum of the measure is assumed for a pure sinusoidal tone of constant frequency, and a correspondingly monotonic change is recorded with increasing variation of frequencies of the signal components. Preferably, definitions of stationarity that are known to a person of ordinary skill in the art may be taken into account for the assignment described. The parameter may represent an absolute quantitative measure that measures the stationarity of the signals to be checked on the basis of a normalized scale, and in particular have a fixed maximum and a fixed minimum, or a relative measure, which in particular does not have any fixed extremum for non-stationary signals.

In particular, a "noise-optimized signal" contains a signal that, with respect to the useful signal components contained in the sound signal, has an SNR optimized relative to the first directional signal and also relative to the second directional signal, if the useful signal components in the sound signal are overlaid by interference components. In particular, the first directional signal and the second directional signal may enter the noise-optimized signal linearly; that is, the noise-optimized signal may have a linear response to a change in the time-frequency domain that occurs in one of the two directional signals at a specific time.

A common approach to noise suppression in hearing devices is first to design the first directional signal such that its direction of maximum sensitivity coincides with the wearer's frontal direction. The second directional signal is then configured to show its direction of maximum sensitivity in a direction other than the wearer's frontal direction, and the direction of minimum sensitivity instead coincides with the wearer's frontal direction. Preferably, in this case, when worn properly in operation, the directional characteristic of the first directional signal with respect to the wearer's frontal plane is a mirror image of the directional characteristic of the second directional signal.

To suppress interference, the first directional signal, which primarily receives the speech signal components of a conversation partner in a frontal direction, is superposed on the second directional signal as a function of the total energy of a resulting signal. In this case, the second directional signal may suppress signal components that do not reach the wearer from the frontal direction, and are thus assumed to be interference. Because the contribution of the first directional signal in the frontal direction is constant, effective suppression of interference requires only the above-mentioned condition of minimum total energy of the signal that results from the superposition.

In contrast, it is now proposed to examine the stationarity of the sound signal via a corresponding parameter, based on the first directional signal and the second directional signal. The procedure proposed in this invention is based on the consideration that when strongly directed interference impinges laterally on the wearer, as is the case for example with the hum of an engine or a household appliance, this interference may be satisfactorily suppressed by the foregoing approach; but in the event that a laterally impinging signal is a useful signal, for example, a speech signal of another speaker coming up from the side, this signal is also suppressed, which would be undesired in this case. For this purpose, a distinction is made between a possible useful signal and possible interference, taking into account that ordinary useful signals such as speech or music usually have a much lower stationarity than most directional interference, as well as the diffuse background noise that may occur for example in the case of a conversation when there are several people in a room, in which additional conversations are taking place (the "cocktail party" hearing situation).

This now makes it possible, for example, to generate the noise-optimized signal from the two directional signals at a low stationarity in such a way that the lowest possible directional suppression of signal components takes place, and thus any speech signals impinging laterally on the wearer are accordingly not suppressed, but instead are amplified. In turn, on the assumption that considerable interference may be present, when elevated stationarity is detected, a directional suppression may occur in such a way that the noise-optimized signal preferentially comprises only the speech signal of an conversation partner, in which the direction of maximum sensitivity of the first directional signal is preferably aligned.

According to the invention, in this case, the parameter is determined from the noise-optimized signal in a signal feedback loop. The parameter could also be calculated, as a purely technical matter, from the first directional signal and the second directional signal—i.e. without further processing the noise-optimized signal itself—but a determination of the parameter from the noise-optimized signal has the advantage that this signal is furnished for further processing in the hearing device, and may be used as a target value. Laborious conversions may thus be omitted.

It is advantageous to calculate an autocorrelation function as a parameter. In this case, the autocorrelation function should preferably be determined via a time window that is suitably determined with regard to the expected useful signals and the expected interference. The advantage of using the autocorrelation function as a parameter is that it often provides additional valuable information that may be relevant in subsequent signal processing.

Conveniently, the noise-optimized signal is generated by a superposition of the first directional signal and the second directional signal, a weighting factor for the superposition being calculated based on the parameter. This means, in particular, that the noise-optimized signal is of the form $F+\alpha \cdot B$, where F is the first directional signal and B is the second directional signal, and a is the weighting factor determined based on the parameter. This superposition is particularly easy to implement from a technical standpoint; in addition, the first directional signal may be oriented in such a way that the direction of maximum sensitivity is oriented toward a conversation partner of the wearer, particularly in the frontal direction, which also facilitates calculating the weighting factor $\alpha$.

In this case, the noise-optimized signal preferably has a substantially omnidirectional directional characteristic for a non-stationary sound signal as a result of the weighting factor, and has a maximally directional directional characteristic for a maximally stationary sound signal as a result of the weighting factor. A "maximally directional directional characteristic" refers in particular to a global maximum of the directional effect within the scope of the available directional signals. This takes account of the circumstance that it is assumed in the case of non-stationary sound signals that there is no interference to be suppressed, but that, on the other hand, there may be speech signals that are laterally incident on the wearer. In this case, a substantially omnidirectional directional characteristic of the noise-optimized signal is advantageous because by this means, speech signals from all spatial directions may be taken into account. In return, it is assumed for a maximally stationary sound signal that a significant proportion of interference is present that must be correspondingly suppressed by a directional characteristic of the noise-optimized signal in such a way that only the spatial direction in which an conversation partner is assumed to be present, i.e. typically the frontal direction, contributes significantly to the noise-optimized signal. A "substantially omnidirectional directional characteristic" refers in particular to such a directional characteristic in which the deviation from perfect omnidirectionality is negligible with respect to the directional effects occurring, in particular in the case of the directional directional characteristics.

In a further advantageous configuration of the invention, the parameter is calculated in such a way that the noise-optimized signal is minimal with respect to the parameter. This may be done in particular by minimizing the noise-optimized signal with respect to the parameter. This approach has the advantage that the noise-optimized signal always has the lowest possible stationarity and thus always the lowest possible interference component.

The noise-optimized signal is expediently minimized with respect to its signal energy, and also with respect to the parameter. This means, in particular, that the noise-optimized signal formed from the first directional signal and the second directional signal, has a local minimum as a function of the signal energy variable and the parameter. As a result, in particular such interference may be suppressed that is incident on the wearer from different directions in a complex hearing situation, wherein additionally a diffuse noise background may be present, while the noise itself may only be partially assumed to be stationary.

Conveniently, in this case, the first directional signal and/or the second directional signal are generated based on a time-delayed superposition of the first microphone signal with the second microphone signal. Preferably, the acoustic transit time difference between the first microphone and the second microphone is used for the time delay in the superposition. This is a particularly easy-to-implement yet efficient method of generating a directional signal when the underlying microphone signals are from non-directional microphones.

In this case, the first directional signal particularly preferably has a directionality in the form of a first cardioid, which is oriented in a first direction, and/or the second directional signal has a directional dependence in the form of a second cardioid, which is oriented in a second direction. A cardioid-shaped signal is characterized in that the direction of minimum sensitivity is opposite the direction of maximum sensitivity. This is not the case, for example, for signals having a directional characteristic in the form of a supercardioid or a hypercardioid. In addition, in the ideal case, a sound signal from the direction of minimum sensitivity is completely suppressed with a cardioid-shaped directional characteristic. The symmetry between the directions of maximum and minimum sensitivity thus makes it possible to keep the calculations of the first and second superposition for interference suppression particularly simple, because in addition, a strictly monotonic increase in sensitivity takes place from the direction of minimum sensitivity to the direction of maximum sensitivity. Particularly preferably, in this case, the first direction is opposite the second direction.

Against the background that in a directional signal with cardioid-shaped directional characteristic sound signals from the direction of minimum sensitivity are completely suppressed in the ideal case, thereby the calculation of the specific weights of the two directional signals in the superposition may be further simplified because the first directional signal may be taken as a reference directed to a first useful signal source, and in this case, when the second cardioid-shaped directional signal is oriented opposite the first directional signal, interference suppression by the second directional signal has no effect on the contribution of the first useful signal.

Thus, to determine the weights for the most efficient possible interference suppression in the case of stationary signals is simply a minimum signal power in the signal resulting from the superposition signal, without this influencing the contribution of the first useful signal. For this purpose, the superposition is preferably initially based on the minimum signal power, then the quantitative parameter for the stationarity is calculated for the resulting signal, and the weighting in the superposition is adjusted using the parameter, in particular iteratively, until the parameter is minimal, so that the resulting signal has a minimal stationarity with respect to the parameter.

The invention further provides a hearing device with a first microphone and a second microphone for generating a first directional signal and a second directional signal, the hearing device being configured to implement the method described above. In particular, in this case the first directional signal and the second directional signal are respectively generated by both the first microphone and the second microphone. Preferably, the method is carried out during operation of the hearing device by means of a control unit, which is particularly preferably configured as part of the signal processing unit in which all other signal processing functions are implemented. The advantages stated for the method and the developments thereof may be transferred analogously to the hearing device.

Other features which are considered as characteristic for the invention are set forth in the appended claims.

Although the invention is illustrated and described herein as embodied in a method of operating a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
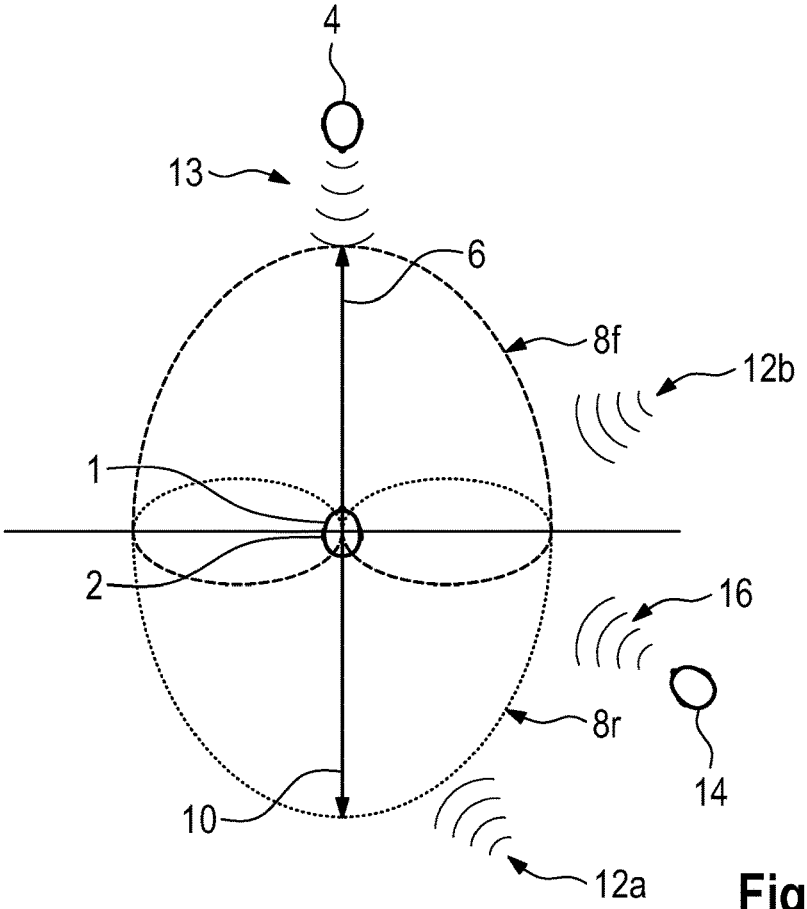
FIG. 1 is a diagrammatic, plan view showing attenuation of a directional interference signal by means of a superposition of two directional signals in a hearing device.

Corresponding parts and sizes are respectively assigned the same reference numerals in all drawings.

Referring now to the figures of the drawings in detail and first, particularly to FIG. 1 thereof, there is shown a wearer 1 of a hearing device 2 schematically in a plan view. The wearer 1 is here in a conversation situation with a conversation partner 4, who is positioned with respect to the wearer 1 in the wearer's frontal direction 6. In a manner not further shown, in the hearing device 2, a first directional signal 8*f* (dashed line) and a second directional signal 8*r* (dotted line) are formed, the directional characteristic being given by a respective cardioid. The cardioid-shaped directional characteristic of the first directional signal 8*f* has the consequence that for sound signals from the frontal direction 6, maximum sensitivity is present and thus sound signals from this direction are maximally received in the first directional signal 8*f*, while sound signals from the reverse direction 10, opposite the frontal direction 6, are ideally completely suppressed in the first directional signal 8*f*. The second directional signal 8*r* has a directionality opposite the first directional signal 8*f*, so that sound signals from the reverse direction 10 are received maximally in the second directional signal 8*r*, while sound signals from the frontal direction 6 are ideally completely suppressed.

The conversation situation of the wearer 1 with the conversation partner 4 is now superposed here by various interferences 12*a*, 12*b*, with 12*a* and 12*b* being highly directional interferences, which are thus respectively emitted from a localizable source such as a motor or an electric household appliance.

To correct a speech signal 13 of the conversation partner 4 from the interferences 12*a*, 12*b* are now attenuated in the hearing device 2 by a superposition of the first directional signal 8*f* with the second directional signal 8*r* of the form $F+\alpha \cdot B$, where F and B are the first or second directional signals 8*f*, 8*r* and a is a weighting factor to be selected accordingly. This makes use of the fact that the useful signal source, in this case the conversation partner 4, is assumed to be in the frontal direction 6, and thus its contributions are completely suppressed in the second directional signal 8*r*, and therefore only penetrate into the signal resulting from the superposition $F+\alpha B$ via the first directional signal 8*f*. The contribution of the second directional signal 8*r* is therefore to be adapted in the resulting signal via the weighting factor $\alpha$ in such a way that the resulting signal has a minimal signal level, not least as a result of the contribution of the useful signal from the frontal direction 6 (see above) which is constant when $\alpha$ varies, ensures maximal attenuation of the signal components that do not come from the frontal direction 6.

If an additional speaker 14 now appears whose voice signal 16 is not incident on the wearer 1 from the frontal direction 6, but rather from a lateral direction, the procedure just described would initially ensure that the speech signal 16 is treated like the interference 12*a*, 12*b* and is correspondingly suppressed. To avoid this, a detection is made as to whether the laterally incident sounds 12*a*, 12*b*, 16 are interference or potential useful signals, and only the interferences 12*a*, 12*b* are suppressed. This is described with reference to FIG. 2.

Figure 2:
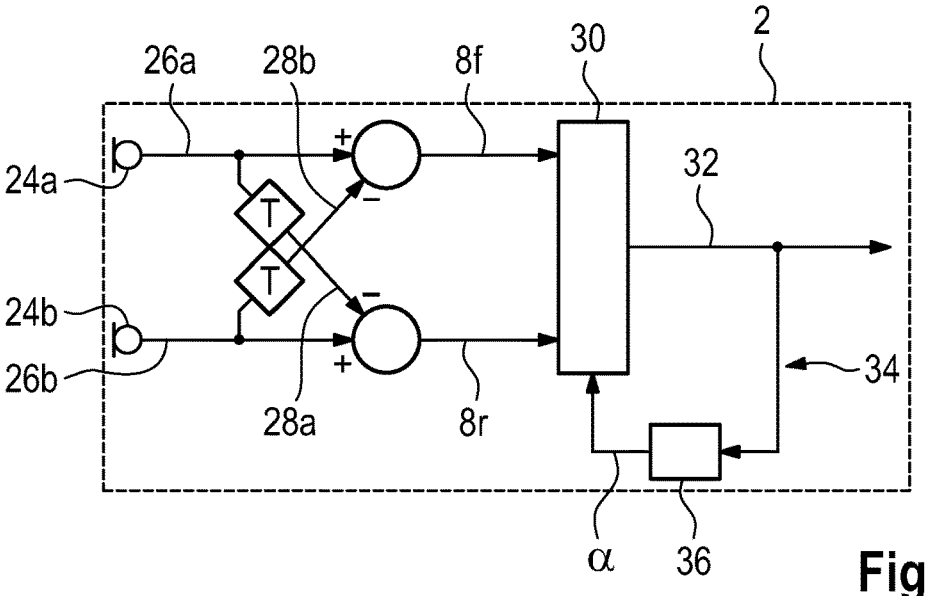
FIG. 2 is a block diagram showing a sequence of a method of attenuation of interference in a hearing device in the presence of simultaneous useful signals from different directions.

FIG. 2 illustrates, by means of a block diagram, a method 20 for directional noise suppression in the hearing device 2. In the hearing device 2, a first microphone signal 26*a* is generated by a first microphone 24*a* from the sound signal 22 of the environment, and a second microphone signal 26*b* is generated by a second microphone 24*b*. The second microphone signal 26*b* is delayed by the time interval T, so that a time-delayed second microphone signal 28*b* is formed, which is subtracted from the first microphone signal 26*a*, so that in this way the first directional signal 8*f* is formed. In the same way, the first microphone signal 26*a* is additionally delayed by the time interval T, thereby forming the first time-delayed microphone signal 28*a*, which is subtracted from the second microphone signal 26*b* so as to form the second directional signal 8*r*. In this case, the first directional signal 8*f* and the second directional signal 8*r* respectively have the cardioid-shaped directional characteristics according to FIG. 1.

In a superposition 30 of the form $F+\alpha \cdot B$, a weighting factor $\alpha$ is now determined in such a way that the signal 32 resulting from the superposition 30 has a minimal stationarity. For this purpose, the resulting signal 32 is fed to a signal feedback loop 34, where a parameter 36 is calculated for the stationarity of the signal components. The parameter 36 may be given, for example, by an autocorrelation function that is calculated over a suitably selected time window.

If it is then found that the signal 32 resulting in a weighting factor $\alpha$ has a minimum stationarity with regard to the parameter 36, i.e. that the parameter 36 for the present superposition 30 assumes a local minimum, then the superposition 30 is not changed further in the signal feedback loop 34. However, if it is determined in the signal feedback loop 34 that the resulting signal 32 has a stationarity parameter 36 which is not minimal, e.g. based on observing the monotonicity of the parameter 36 with small variations of a around the present value, the weighting factor $\alpha$ in the superposition 30 is adjusted so as to minimize the parameter 36. This may be done interactively in particular. Also conceivable is a parameter 36 that provides an absolute measure of stationarity and is in particular suitably normalized, so that it becomes possible to make a quantitative statement about the necessary adjustment of the weighting factor $\alpha$ from the value of the parameter 36 to a present superposition with a weighting factor $\alpha$ and from the corresponding distance of the parameter 36 from the minimum value.

If, for example, in the conversation situation according to FIG. 1, only the speech signal 13 of the conversation partner 4 and the two interferences 12*a*, 12*b* are present, then the speech signal is non-stationary, while the two noise noises 12*a*, 12*b* are highly stationary. For the superposition 30, the weighting factor $\alpha$ should be determined in such a way that in $F+\alpha \cdot B$ the signal components of the interferences 12*a*, 12*b* are eliminated to the extent possible via the second directional signal B. This is done by a negative weighting factor $\alpha$ of the amount <1. In this case, the resulting signal 32 substantially corresponds to the signal that would also be achieved by minimizing the signal energy, because the speech signal 13, which enters the resulting signal 32 through F, is non-stationary, and its signal components are not impacted by corrections of the stationary signal components by means of the signal B.

If, on the other hand, in the conversation situation according to FIG. 1, only the speech signal 13 of the conversation partner 4 and the speech signal 16 of the conversation partner 14 are present, a superposition 30 based on minimizing the energy of the resulting signal 32 would significantly suppress the speech signal 16 of the conversation partner 14, which is undesired. However, because the determination of the weighting factor $\alpha$ is not based on minimizing the energy of the resulting signal 32, but on minimizing its stationarity—as measured by parameter 36—the signals are largely added in the form $F+\alpha \cdot B$, resulting in a largely omnidirectional directional characteristic for the resulting signal 32.

Due to the additional contributions of the speech signal 14 in the signal B, the already low stationarity of the speech signal 13 is further reduced in the resulting signal 32 as a result of the different conversation partners 4, 14 and thus the different spectral contributions. The weighting factor $\alpha$ is now positive, and is configured so that it compensates as much as possible for the attenuation of the speech signal 16 by the lateral attenuation of the directional characteristic of the first directional signal 8*f*.

If both speech signals 13, 16 and both interferences 12*a*, 12*b* are present in the speech situation according to FIG. 1, the minimization of the stationarity of the resulting signal 32 will result in the stationary noise 12*a*, 12*b* contributing as little as possible to the resulting signal 32, while the non-stationary speech signal 16 is suppressed as little as possible. Because only one degree of freedom is available—the weighting factor $\alpha$—this is only possible with limitations; the resulting signal 32 is no longer minimal in a with regard to signal energy, but this is accepted in view of the complex conversation situation, in order to avoid an undesired suppression of the speech signal 16.

By the approach described, interferences of the form 12*a*, 12*b* are suppressed, while the signal components of the speech signal 16 are not suppressed, so that the signal 32 resulting from the superposition is a noise-optimized signal.

The invention has been illustrated and described in detail by means of the preferred exemplary embodiment, but this embodiment does not limit the invention. Other variations may be deduced therefrom by a person of ordinary skill in the art, without departing from the protected scope of the invention.

The following is a summary list of reference numerals and the corresponding structure used in the above description of the invention:

1 Wearer
2 Hearing device
4 Conversation partner
6 Frontal direction
8*f* First directional signal
8*r* Second directional signal
10 Reverse direction
12*a, b* Interference
13 Speech signal
14 Conversation partner
16 Speech signal
20 Method
22 Sound signal
24*a/b* First/second microphone
26*a/b* First/second microphone signal
28*a/b* First/second time-delayed microphone signal

30 Superposition
32 Resulting/noise-optimized signal
34 Signal feedback loop
36 Parameter
T Time interval

The invention claimed is:

1. A method of operating a hearing device, which comprises the steps of:

generating in the hearing device a first microphone signal from a sound signal obtained from an environment by a first microphone;

generating a second microphone signal from the sound signal by a second microphone;

generating a first directional signal and a second directional signal based on the first microphone signal and the second microphone signal;

modifying the first directional signal and/or the second directional signal based on a time-delayed superposition of the first microphone signal with the second microphone signal;

determining a parameter based on the first directional signal and the second directional signal, the parameter representing a quantitative measure of a stationarity of the sound signal;

generating a noise-optimized signal from the first directional signal and the second directional signal based on the parameter by superposing the first directional signal and the second directional signal and calculating a weighting factor for the superposing with reference to the parameter; and determining the parameter from the noise-optimized signal in a signal feedback loop.

2. The method according to claim 1, which further comprises calculating an autocorrelation function as the parameter.

3. The method according to claim 1, wherein for a non-stationary sound signal, as a result of the weighting factor, the noise-optimized signal has a substantially omnidirectional directional characteristic; and wherein for a maximally stationary sound signal, as a result of the weighting factor, the noise-optimized signal has a maximally directional directional characteristic.

4. The method according to claim 1, which further comprises determining the parameter such that the noise-optimized signal is minimal with regard to the parameter.

5. The method according to claim 1, which further comprises minimizing the noise-optimized signal with respect to signal energy and with respect to the parameter.

6. The method according to claim 1, wherein:

the first directional signal has a directionality in a form of a first cardioid oriented in a first direction; and/or the second directional signal has a directionality in a form of a second cardioid oriented in a second direction.

7. The method according to claim 6, wherein the first direction is opposite the second direction.

8. A hearing device, comprising:

a first microphone for generating a first directional signal;

a second microphone for generating a second directional signal;

a processor programmed to:

modify the first directional signal and/or the second directional signal based on a time-delayed superposition of the first microphone signal with the second microphone signal;

determine a parameter based on the first directional signal and the second directional signal, the parameter representing a quantitative measure of a stationarity of a sound signal;

generate a noise-optimized signal from the first directional signal and the second directional signal based on the parameter by superposing the first directional signal and the second directional signal and calculating a weighting factor for the superposing with reference to the parameter; and determine the parameter from the noise-optimized signal in a signal feedback loop.

* * * * *